US005155710A

United States Patent [19]

Roop

[11] Patent Number: 5,155,710

[45] Date of Patent: Oct. 13, 1992

[54] CLOCK WITH MOON DIAL

[75] Inventor: Thomas Roop, Bassett, Va.

[73] Assignee: Pulaski Furniture Corporation, Pulaski, Va.

[21] Appl. No.: 588,768

[22] Filed: Sep. 27, 1990

[51] Int. Cl.[5] ..... G04B 19/26

[52] U.S. Cl. ..... 368/18

[58] Field of Search ..... 368/16-19

[56] References Cited

U.S. PATENT DOCUMENTS 1,997,511 4/1935 Canepa ..... 368/18
2,451,130 8/1981 Burmann ..... 368/18
3,092,257 12/1984 Seem ..... 368/18
4,548,512 10/1985 Erard ..... 368/18
4,684,260 8/1987 Jackle ..... 368/16

*Primary Examiner*—Vit W. Miska
*Attorney, Agent, or Firm*—William J. Daniel

[57] ABSTRACT

A clock with a movable moon display having an improved moon dial in which a moon replica plate is associated integrally with the moon dial in spaced recessed relation to a round opening in the dial so that the moon replica takes on a shadowed illusion of depth while moving bodily with the dial transit of the display. This shadowed illusion can be disirably emphasized or enhanced by the provision within the clock housing of a source of illumination impinging on the display.

14 Claims, 2 Drawing Sheets

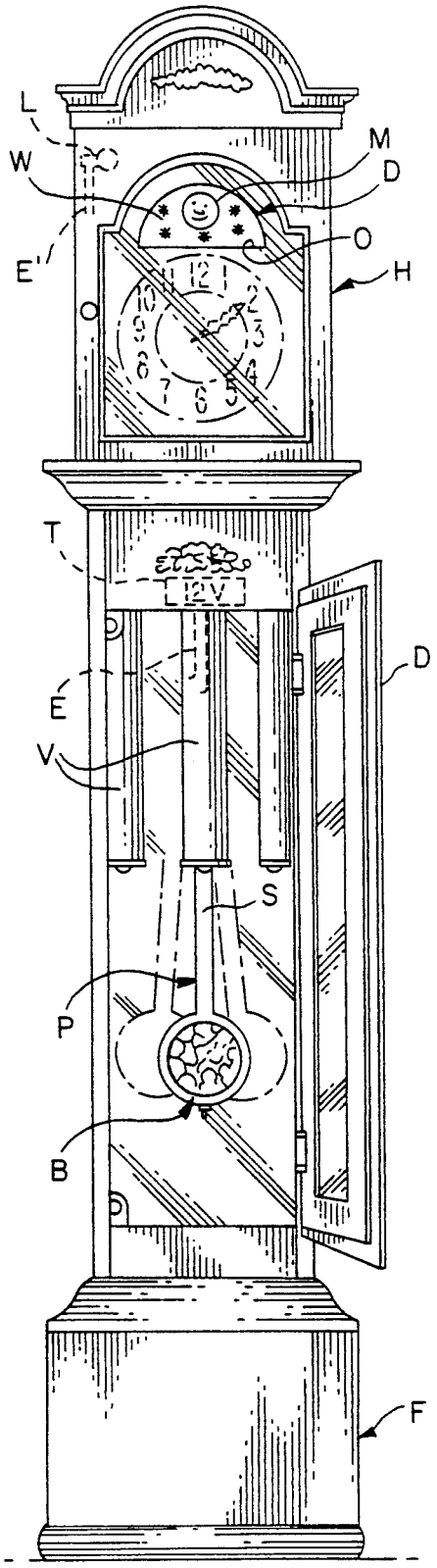
FIG. 1
FIG. 3
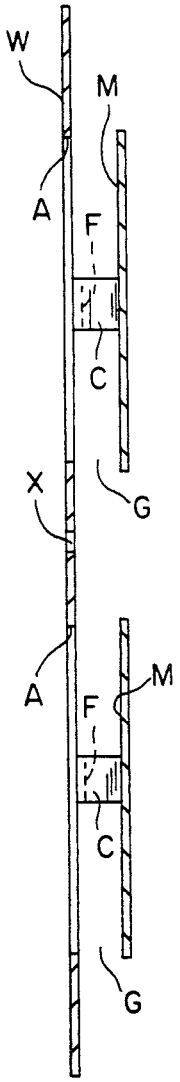
FIG. 4
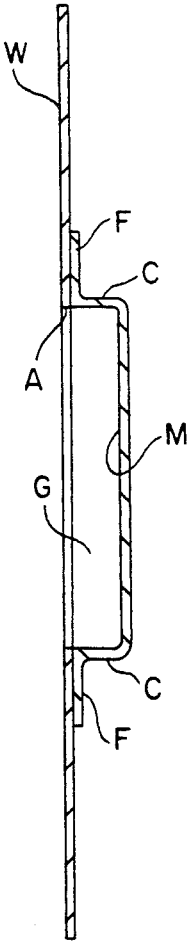

CLOCK WITH MOON DIAL

FIELD OF THE INVENTION

This invention relates to the field of clocks and is concerned more particularly with clocks provided with a movable moon display which, in synchronism with the movement of the clock hands or other time indicator, simulates the phase changes of the moon during the lunar cycle.

BACKGROUND OF THE INVENTION AND SUMMARY OF PRIOR ART

For at least the last 100 years, it has been known to provide clocks with a movable moon display which feature shows a replica of the moon passing from one side of a display opening in the clock face to the other in timed relation with the timekeeping mechanism of the clock. Early versions of such moon displays are disclosed in U.S. Pat. No. 508,467, granted Nov. 14, 1893, U.S. Pat. No. Des. 23,026, granted Jan. 30, 1894 and U.S. Pat. No. 1,126,214 granted Jan. 26, 1915. In the usual moon display, the clock face is provided with an arcuate display opening, generally shaped as a semicircular segment for simplicity, and arranged behind this opening is a moon dial or disc of a size, e.g., diameter, large enough to completely fill the opening. On the front face of the dial is at least one replica of the moon and commonly a second replica is included at a diametrically opposite location on the dial face. Each moon replica is of a diameter considerably smaller than the radius of the display opening to be visible in full therethrough. The moon dial is rotated about its axis in periodic small stepwise increments, usually by means of a ratchet and pawl drive although other drives can be substituted. The ratchet teeth are conveniently formed around the outside periphery of the dial, beyond the limits of the display opening so as to be hidden from view, and are engaged by a pawl rocked periodically by gears or the like driven from the mechanical works of the clock. Thus, gradual rotation of the dial causes the moon replica to advance slowly across the display opening in a roughly 180° arc, simulating the changes in the moon during the lunar cycle. Through appropriate selection of gear ratios, this simulated moon behavior can be generally coordinated timewise with the changes of the real moon. If desired, the margins of the clock face on each side (or ends in terms of moon replica travel) of the display opening can be formed as a protruding semicircular extension corresponding in radius to the moon replica so as to overlap with the replica regressively, i.e., from new moon to full moon, as the replica enters the display opening and then progressively as it leaves the opening and thus more closely resemble the changing appearances of the moon during the lunar cycle.

Movable moon displays of this type are commonly seen in large case clocks, such as tall case or grandfather's clocks but they are also found in smaller clocks such as wall clocks or mantle clocks and have even been adapted for wristwatches and the like. Most often, the moon display is situated at the top end of the clock face above the dial, as can be seen in U.S. Pat. No. 1,126,214, identified above, but it can also be situated within the hour dial as appears in U.S. Pat. No. 508,467. The moon replica itself can take the form of a plain circular area of light color, e.g., yellow or golden, associated with the moon but custom apparently favors the inclusion of human facial characteristics no doubt symbolic at least in caricature of the proverbial "man in the moon." However, the moon replica can show more accurate astronomical features as seen in U.S. Pat. Des. No. 244,672. The remainder of the front face of the moon dial is of a contrasting coloration, normally dark in tone to represent the night sky and ornamentation suggestive of stars and other cosmic objects, either real or figurative, is commonly added.

In standard moon displays known in the art, the moon dial or disc is a continuous circular plate with flat front and rear faces carrying on its front face the indicia referred to above applied thereto by paint, enamel, metallic embellishment or the like. Consequently, the visual appearance of the moon replica necessarily gives a crude prosaic one-dimensional impression which remains fixed during the passage of the replica, across the display. Such moon displays unfortunately lack even a hint of realism or any change in effect that might add interest to their visual impression.

In recent years, with a focus on increased sophistication, moon displays have been designed to convey a more controlled simulation of the change in the phases of the moon, as can be found in U.S. Pat. Nos. 4,548,512, granted Oct. 22, 1985, 4,684,260, granted Aug. 4, 1987 and 4,692,031, granted Sep. 8, 1987. In these more complex devices, the moon dial and moon replica are made separate, the moon dial having one or more small circular moon openings therein corresponding to the size of the moon replica. A second small disc of less than one-half the dial diameter is situated behind each such moon opening and the face of this disc is colored to simulate the moon's appearance except for one or more dark circular regions generally coextensive in diameter with the moon opening in the dial. The separate moon dial and replica disc are mounted for independent relative rotation, with the replica disc translating bodily with the dial as the latter rotates while being itself rotated independently in gradual steps about its own axis. In this manner, changes in the phase of the moon replica can be achieved independently of the movement of the dial as a whole by rotating the dark replica region into and out of view through the moon opening, the remaining light colored replica region seen through the moon openings representing the waning and then waxing moon. In this way, the relative positions of the opening and the replica are precisely adjustable and the replica can remain in a given phase position as the moon dial as a whole makes a daily transit through the display opening in the clock face, the phase relation being gradually changed during subsequent transits.

Nevertheless, even in these more sophisticated constructions, any suggestion of depth or suspension in space for the moon replica is minimal and is only incidental to the need for independent relative rotation of the dial and replica disc, necessitating two separate elements, rather than being deliberately emphasized. The axial separation between the elements is slight at best and the area of the replica disc has to greatly exceed that of the associated moon opening in the dial so that the dial opening is essentially completely blocked by the closely proximate replica disc. Hence, even if illumination were present within the clock interior, it would not be visible through the moon opening.

OBJECTS OF THE INVENTION

It is the object of the present invention to provide a clock with a movable moon display having an improved moon dial in which a moon replica plate is associated integrally with the moon dial in spaced recessed relation to a round opening in the dial so that the moon replica takes on a shadowed illusion of depth while moving bodily with the dial during transit of the display. This shadowed illusion can be desirably emphasized or enhanced by the provision within the clock housing of a source of illumination impinging on the display. This illumination source, which can take the form of an energizable light source, is visible through an axial clearance gap between the circular margin of the dial opening and the peripheral edge of the recessed replica so as to illuminate at least a region of the replica face while leaving another region shadowed. Dependent upon the relative direction of the light rays, the proportion of illuminated to shadowed regions may gradually change during the transit of the display, enhancing the visual impact of the display.

BRIEF DESCRIPTION OF THE DRAWINGS

These and other objects of the invention will be explained more fully in the following detailed description when read in conjunction with the accompanying drawings, in which:

FIG. 1 is a front elevation view of a tall case clock, such as a grandfather's clock in a traditional Early American style, including a moon display of the type generally corresponding to the present invention;

FIG. 3 is a vertical sectioned view taken substantially along line 3—3 of FIG. 2;

FIG. 4 is a horizontal sectional view taken substantially along line 4—4 of FIG. 2;

DETAILED DESCRIPTION OF ILLUSTRATIVE EMBODIMENTS

Figure 2:
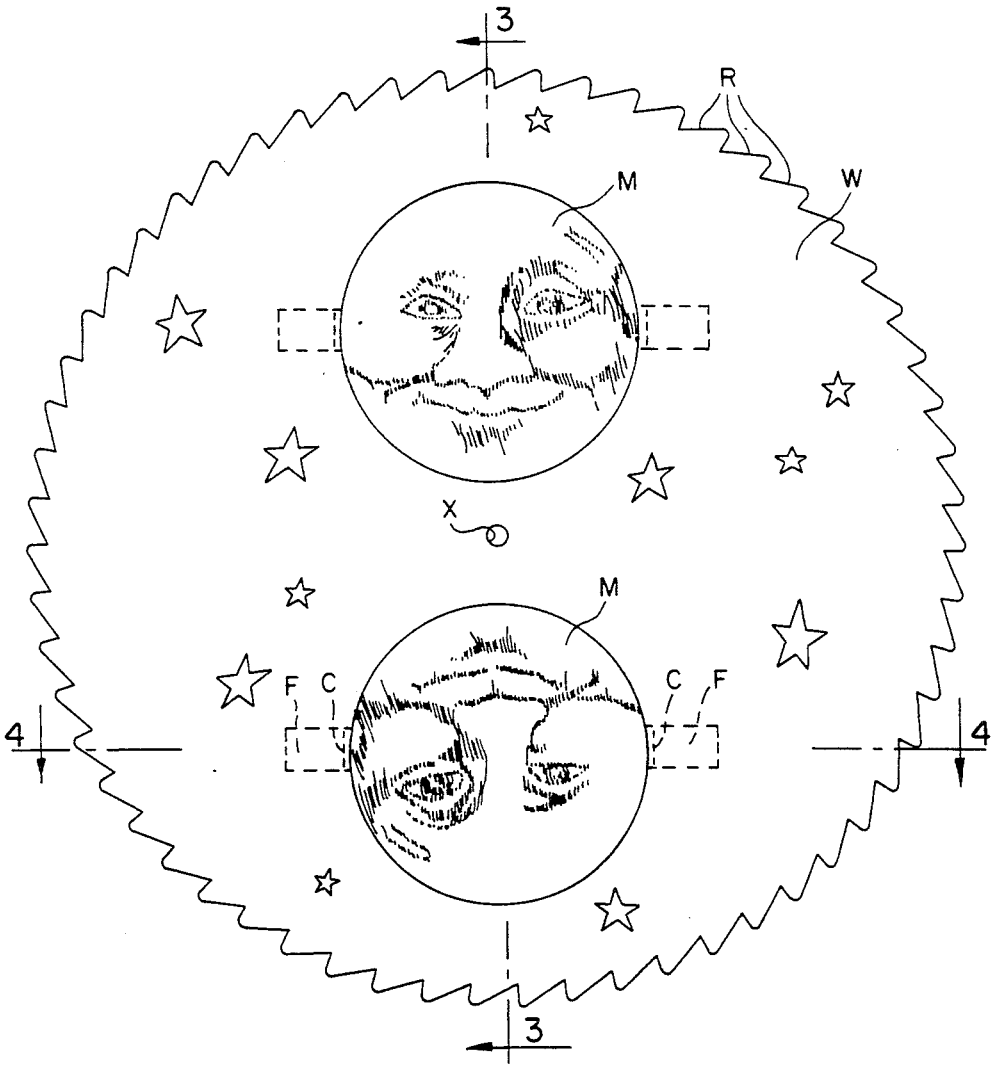
FIG. 2 is an enlarged detail view the front face of a moon dial embodying the present invention.

A simplified version of a clock including a movable moon display corresponding generally to the present invention is shown in front elevation in FIG. 1. The clock in FIG. 1 is of the tall case variety and could be either of the grandfather or grandmother type depending upon its overall size. While clocks utilizing the invention can have a casing structure designed in any of a variety of furniture styles or periods, the clock in FIG. 1 is in a traditional Early American style and includes, as is usual for tall case clocks, an upper hood section H, a lower base section B and an intervening elongated waist section W. The latter, as shown, is of reduced width wise dimension compared to the hood and base sections but could, of course have a larger or smaller width. The clock is provided with various moldings or other ornamental details corresponding to its style, but such design details play no part in the present invention and will not be described further inasmuch as they are susceptible of wide variations. The "clockworks" are mounted within the hood section H behind the clock face with at least the dial, including the hands, being visible through an appropriate opening in the front side of the hood section, which can be covered by a transparent, e.g., glass, panel provided in an openable door in the front side of the hood. The clockworks themselves are concealed behind the face of the clock, being enclosed within the sidewalls and rear wall of the hood section of the casing.

As is visible in FIG. 1, housed within the interior of the waist section W is a swinging pendulum generally designated P, together with a plurality of weights, generally three in number, generally designated V. The weights are suspended on cables or chains and move downwardly under the force of gravity so as to supply the driving power for the clock mechanism, including the striking mechanism where present. When the weights reach their lower limit of travel, they must be rewound to their upper starting position by means of the chains or in some more modern systems, by means of winding handles, all as is well known in the art.

Preferably, the clock of present invention incorporates the features disclosed and claimed in U.S. application Ser. No. 07/501,552, filed Mar. 30, 1990, now U.S. Pat. No. 5,007,076 wherein the pendulum P is modified from its conventional structure to incorporate an electrically energizable light source. Ordinarily it is preferred that this light source is not directly visible by an observer facing generally the front side of the clock, although the illumination it provides is so visible, and hence the light source cannot be seen as such in association with the pendulum P in FIG. 1, being merely suggested there by dotted lines. Electrical leads to energize the light source extend lengthwise of the pendulum and are likewise concealed by the pendulum so that they cannot be seen in FIG. 1, only a fragment of such leads being shown in dotted lines under the general designation E near the upper end of the waist section W to indicate their presence. These leads are preferably supplied with low voltage electrical current at a voltage level that is entirely safe for humans, say 12 or 16 volts D.C. and a transformer or other voltage converting device T is provided within the clock casing at a location concealed behind solid frame members of that casing. Obviously, the location of the transformer could vary widely and one possible location is suggested in dotted lines just above the front opening of the waist section W. That opening is intended to be closed by means of a swingable door designated D shown in open position in FIG. 1 and door D is constituted of a central elongated glass or other transparent panel carried within a vertically elongated frame and the swinging movement of pendulum P can be easily observed from the front exterior of the clock through the glass panel in door D. In some clocks of this type, similar glass panels are likewise provided in the left and right side panels of the waist section; all such side panels can be solid if preferred.

In the preferred practice of the invention, the interior face of the rear or backwall of waist section W is constituted by a reflective or mirrored surface S, suggested by shading visible through the open door D, inasmuch as the reflection of the lighted swinging pendulum from such mirror visible to an outside observer contributes to the ornamental attractiveness of the lighted pendulum feature.

In the clock of FIG. 1 for illustration purposes, the pendulum is of a simplified variety, generally referred to in the art as a "stick" pendulum. Such a pendulum includes an elongated stick-like supporting rod carrying adjacent its lower end a pendulum head or bob designated B normally of discoid-shape, although other shapes are certainly conceivable. Thus, pendulum bob B can have a generally circular configuration when seen in front elevation and a maximum thickness, when viewed from the side, at its approximate center or axis, tapering from that maximum thickness to a rounded peripheral edge so as to define a hollow interior. It can be conveniently constituted to dish-shaped members of opposing concavity joined together along their peripheral edges or rims with their convex sides facing outwardly.

As disclosed more fully in U.S. application Ser. No. 07/501,552, the pendulum bob B has, an energizable light source, e.g., light bulb, mounted within its hollow interior and its front and rear faces are perforated or otherwise formed to be penetrable by light emanating from that source.

In accordance with the present invention, the clock in FIG. 1 is provided with a movable moon display generally designated D. The display D is visible through a display opening 0 formed in the face of the clock. As shown, display opening 0 is formed as a semicircular sector of a circle although other arcuate shapes are imaginable, such as a sector of 120° or even 90° as well as an annular slot of corresponding arcuate extents. The configuration of the opening is not of importance so long as it defines a sufficient area across which the display can pass in view.

Mounted directly behind display opening 0 is a circular moon dial or disc W which is of a diameter at least slightly larger than opening O as to completely fill the latter. Moon dial W is mounted for rotation about its center axis generally coaxially with opening O on a supporting shaft not visible in FIG. 1 but which is in any case conventional in nature.

On the front face of dial W is a replica of the moon designated M which can include, as indicated, a semblance of human facial characteristics. Stars can also be scattered across the background region of the dial, several of which can be seen in FIG. 1.

Moon dial W is rotated slowly in periodic stepwise increments around its axis and during such rotation, moon replica M travels in an arc of about 180° from one lower side of display opening O to the opposite lower side. For a semicircular opening, the word "side" may seem inept since both such "sides" lie upon a common diameter or chord of the moon dial W. The term "side" will hence be understood as having reference to the center axis of the semi-circle and corresponding to the "ends" of the display opening in terms of the path of travel of the moon replica through such openings.

In FIG. 1, the moon display D is shown in a location near the top of hood section H above the dial of the clock, as is commonly the case with such displays in the art. Other locations are equally suitable, however. Thus the display could be located inside the circular row of numbers on the dial. Alternatively, the movable display could appear below the dial or even elsewhere in the clock casing if this should be preferred, inasmuch as location of the display is not a limiting feature of the invention.

Figure 5:
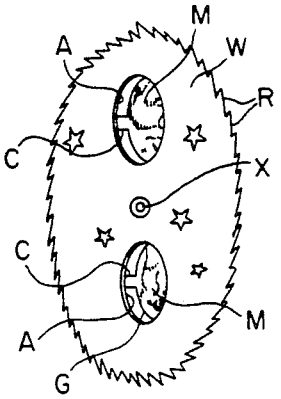
FIG. 5 is a frontal isometric view of the improved moon dial of FIG. 2.
Figure 6:
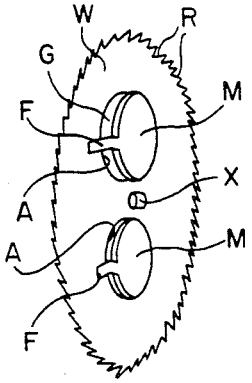
FIG. 6 is a rear isometric view of the moon dial of FIG. 2.

In order to better reveal the novel construction of the invention, the moon dial W embodying the invention is shown in FIGS. 2–4 in detail, greatly enlarged compared to FIG. 1, and on a somewhat smaller scale in the isometric views of FIGS. 5 and 6. As is evident, moon dial W has the form of a circular disc having its exterior peripheral edge shaped as ratchet teeth R suitable for cooperation with a driving pawl, not shown. As previously indicated, the driving arrangement is conventional and other arrangements can be substituted. The dial periphery could, for instance, be shaped as gear teeth corresponding to a circular rack and adapted to be engaged by a pinion gear to gradually advance the same. A small central opening X is shown at the center axis of the dial for mounting on a suitable supporting shaft, also not shown.

At least one circular moon opening or aperture A is cut away in the dial, roughly equidistant between axis X and the dial periphery, to serve as a moon opening and preferably two such openings are present at diametrically opposite locations as shown. The size of the moon openings A is variable but in any case must be smaller than the radius of dial W but sufficiently large to be prominently visible, say about half the radius length or slightly greater.

Immediately behind each moon opening A and coaxial therewith is a separate circular moon replica plate M which again can incorporate human facial characteristics as illustrated and is freely visible through the corresponding moon opening A. The diameter of each replica plate generally corresponds to the diameter of opening A and may perhaps slightly exceed that diameter so that the outer circular margin of the plate overlaps to some degree with the margin of the associated opening A. A replica plate greatly larger than its opening A should be avoided.

As is most directly seen in FIGS. 3 and 4, each such replica plate M is supported in spaced parallel relation to the plane of moon dial W. In other words, each plate is recessed rearwardly of the dial. This spacial separation between each replica plate and the dial in the axial direction can be achieved by various mechanical forms of support. One simple connection suitable for this purpose is a rudimentary bracket in the form of legs C extending forwardly from diametrically opposite sides of each moon replica plate M generally perpendicular thereto with laterally extending angular feet F at their free ends, anchored in some suitable way to the rear face of the dial, such as by spot welding, a bonding adhesive or the like. The bracket can be formed separately of the associated replica plate but preferably the moon replica plate is formed e.g., by stamping, with integral diametrically opposed, extensions which then can be bent as needed to constitute the bracket legs. In any case, the bracket legs extend in width over only a short arc of the replica periphery and are obscured by the overlapping margins of the dial opening A so as to be not readily visible when the clock is viewed from its front.

With each replica plate located in recessed axially displaced relation rearwardly of the moon final, a peripheral clearance gap G is created which introduces an aspect of depth to the appearance of the moon replica which can convey an illusion that the moon replica is "suspended in space" behind the moon dial. In addition, the combination of this depth with the at least generally coextensive areas of the replica and associated opening, a shadowed effect can be cast on the frontal face of the replica and this effect can be enhanced or exaggerated by utilization of suitable illumination in the region of the clock hood or other casing section.

Thus, some means of creating illumination in the interior region of the clock rearwardly of the moon display preferably forms a part of the present invention and various options are available in this regard. As one example of such illuminating means, panels of glass or other transparent material can be placed in the side walls of the clock case in the region of the movable moon display, e.g., of the hood section, so as to permit ambient light to penetrate into that region of the casing so as to impinge upon the visible face of the moon replica and enhance the shadowed effect cast there upon. A further alternative has been indicated in dotted lines in FIG. 1 in the form of an illumination source designated L, such as a small light bulb and related socket, which can be energized by electrical current, preferably of low voltage, supplied thereto through suitable electrical leads E', shown only fragmentarily, and connected for instance to transformer T or other current source. For illustration purposes, illumination source L has been shown within hood section H to the left and slightly above the movable moon display D but this location can be changed as might be desired as regards any of the three dimensions available, that is, any or all of the height, width, and depth dimensions relative to the display D, so as to optimize a particular effect of depth and shadow, as desired.

With the moon display located above the dial, the interior space inside the hood section behind and to the sides of the moon display is open and free of mechanical elements. The clockworks generally do not extend much above the upper limits of the dial and the drive for the display can operate at the lower side of the dial periphery well out of the way. Hence, the energizable light source can be situated virtually anywhere within this space. It could be directly behind the approximate center of the display opening adjacent the rear wall of the section, shifted right or left from such center, and/or forwardly from the rear wall so that the light rays penetrate the clearance gap from a more lateral and less perpendicular direction. By experimentation with different relative positions for the light source, one can easily find the best position of a particular effect to be achieved with a given combination of design conditions.

As shown, the front face of the modified moon dial W can carry other ornamental features such as stars of various sizes, and generally, the background region of the dial face has a contrasting color with respect to the light colored tone of the moon replica M, such as dark blue or almost black, so as to enhance the visual prominence of the replica, although such coloration has been omitted from the present drawings. The display opening could also be modified in the manner described above whereby the lower diametrical edge thereof carries two opposite semi-cylindrical extensions more or less equal in diameter to the moon replica M in order to correspond more closely to the effect of changing phases during the lunar cycle.

Other modifications may well occur to those skilled in this field and it will be consequently understood that the invention is not intended to be restricted to the illustrated embodiment, being only as necessitated by the language of the appended claims.

What is claimed:

1. In a clock having a face plate in which a sectorial opening is provided and a movable moon display behind said face plate and partially visible through said sectorial opening in the clock face plate, said moon display comprising a moon disc supported for rotation about its axis in close-spaced proximity behind the face opening with a radius at least equal to that of the opening, said disc having at least one moon replica on its frontal side toward the face plate opening for visibility through said opening and being rotated stepwise around its axis in synchronism with the movement of the clock to advance said moon replica from one side of said sectorial opening to the other and thus simulate the passage of the moon through the sky, in combination, the improvement wherein said moon disc has at least one circular opening therein and said moon replica is a generally circular plate of an area generally coextensive with said circular opening which is carried on the rear of said disc for movement therewith in parallel recessed relation thereto behind each such disc opening and generally concentric therewith to define an illumination gap between the replica plate edge and the margin of the circular disc opening to thereby impart to the face of the moon replica plate visible through said disc opening an aspect of shadowed depth.

2. The clock of claim 1, including means for illuminating at least a portion of said moon replica plate through said illumination gap.

3. The clock as in claim 2, wherein the illuminating means comprises a light source in said clock energizable to illuminate such portion of said moon replica plate through said illumination gap.

4. The clock in claim 1, wherein such face of the circular moon replica plate carries indicia suggestive of the moon's appearance.

5. The clock as in claim 1, wherein said replica plate is supported by bracket means anchored to the rear of said moon disc.

6. The clock of claim 5, wherein said bracket means comprises rearwardly offset opposed legs attached to the disc rear on opposite sides of the disc opening.

7. The clock of claim 1, wherein said moon disc has two circular openings therein at diametrically opposite locations and a circular moon replica plate is carried on the disc rear behind each such opening.

8. A moon dial for a clock comprising a generally circular flat disc having front and rear faces, at least one generally circular opening in said disc between its center axis and its periphery, and integrally mounted on the rear disc face for bodily movement therewith behind each such circular opening for visibility therethrough a generally circular moon replica plate generally coextensive in area with such opening, said moon replica plate being held in rearwardly spaced relation to the rear face of the disc to define an illumination gap between the replica plate edge and the margin of the circular disc opening to thereby impart to the face of the moon replica plate an aspect of shadowed depth.

9. The moon dial of claim 8 wherein the face of said replica plate visible through each such opening carries indicia suggestive of the moon's appearance.

10. The moon dial of claim 8 wherein said disc has two such openings in diametrically opposite positions relative to its axis and each such opening has a said moon replica plate mounted therebehind.

11. The clock of claim 1 wherein said moon replica plate and said moon disc are in generally spaced parallel relation to each other and to the clock face plate.

12. The clock of claim 1 wherein the peripheral edge of said moon disc is generally uniformly serrated and said clock further includes driving means in engagement with the serrated disc edge to rotate the same.

13. The moon dial of claim 8 wherein said moon replica plate and said moon disc are in spaced generally parallel relation.

14. The moon dial of claim 8 wherein the peripheral edge of said moon disc is generally uniformly serrated.

* * * * *